United States Patent [19]

Kanchev

[11] Patent Number: 4,703,509

[45] Date of Patent: Oct. 27, 1987

[54] ELECTROSTATIC ACOUSTIC CONVERTER WITH STATIONARY ELECTRODE HAVING A PROGRESSIVELY INCREASING SURFACE RESISTANCE

[75] Inventor: Peter K. Kanchev, Sofia, Bulgaria

[73] Assignee: Zavod za Elektronni Preobrazuvatelni Elementi, Sofia, Bulgaria

[21] Appl. No.: 746,356

[22] Filed: Jun. 19, 1985

Related U.S. Application Data

[63] Continuation-in-part of Ser. No. 460,635, Jan. 24, 1983, abandoned.

[51] Int. Cl.[4] ..... H04R 19/02

[52] U.S. Cl. ..... 381/191

[58] Field of Search ..... 179/111 R, 115.5 PV, 179/111 E; 307/400; 310/309; 381/114, 116, 191, 196

[56] References Cited

U.S. PATENT DOCUMENTS

| | | | |
|---|---|---|---|
| 3,008,014 | 11/1961 | Williamson et al. | 381/191 |
| 3,014,098 | 12/1961 | Malme | 381/191 |
| 3,135,838 | 6/1964 | Wright | 381/191 |
| 3,773,984 | 11/1973 | Walker | 381/191 |
| 3,892,927 | 7/1975 | Lindenberg | 381/191 |
| 3,942,029 | 3/1976 | Kawakami et al. | 307/400 |
| 4,338,489 | 7/1982 | Görike | 381/191 |

FOREIGN PATENT DOCUMENTS

| | | | |
|---|---|---|---|
| 537931 | 7/1941 | United Kingdom | 179/111 R |

*Primary Examiner*—Gene Z. Rubinson
*Assistant Examiner*—Danita R. Byrd

[57] ABSTRACT

An electrostatic acoustic converter having two parallel, insulating perforated plates, the inner surfaces of which are covered by electrically resistive layers, each having a signal terminal for connection to a source of sound frequency signals. Between the plates there is fixed a flexible plastic diaphragm isolated from the layers and having a terminal for connection to a source of polarizing voltage.

2 Claims, 3 Drawing Figures

FIG. 2
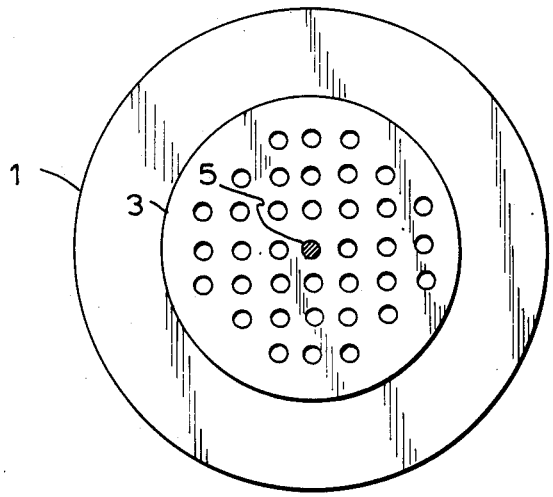
FIG. 1
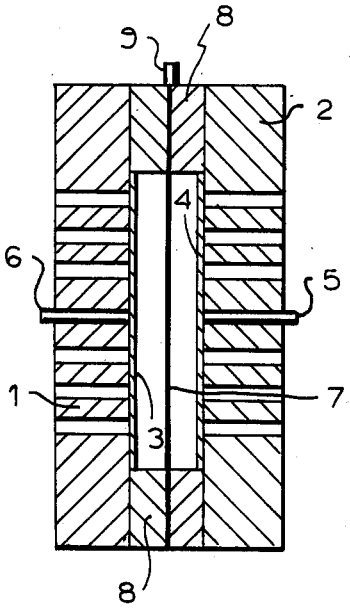
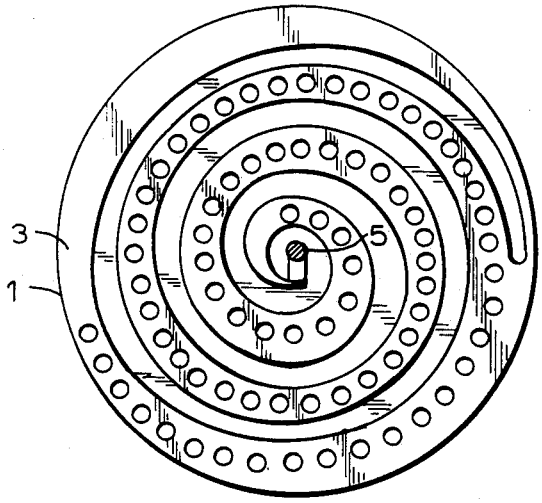
FIG. 3

ELECTROSTATIC ACOUSTIC CONVERTER WITH STATIONARY ELECTRODE HAVING A PROGRESSIVELY INCREASING SURFACE RESISTANCE

BACKGROUND OF THE INVENTION

This application is a continuation-in-part application of application Ser. No. 460,635, filed Jan. 24, 1983 now abandoned.

This invention relates to electrostatic acoustic converters applicable in sound reproducing devices and works on the push-pull principle.

An electrostatic acoustic converter is known which consists of two parallel stationary electrodes. Each of the stationary electrodes is perforated and has a signal terminal for connection to a source of sound frequency signals. Between the stationary electrodes there is fixed a flexible plastic partially conductive diaphragm isolated from the stationary electrodes and having a terminal for connection to a source of polarizing voltage. A disadvantage of this converter lies in the fact that it is impossible to regulate and control the polar characteristics of the emissions therefrom.

An electrostatic acoustic converter is also known which consists of two parallel, solid, insulating perforated plates, the inner surfaces of which are covered by metal layers, the layers each being divided into concentric rings isolated one from the other and connected in series through a serial arrangement of additional coils and resistors. The central discs of the respective conductive layers have signal terminals for connection to a source of sound frequency signals. Between the plates, there is mounted a flexible plastic partially conductive diaphragm, isolated from the metal layers, and having a terminal for connection with a source of polarizing voltage. The disadvantages of the converter are complicated construction and step-wise changes in frequency and polar characteristics of emissions, the result of which reproduction is irregular.

SUMMARY OF THE INVENTION

The object of the present invention is to create an electrostatic converter with simplified construction which also allows the possibility of smooth regulation and control of the polar charcteristic of emission and uniformly distributed spatial and frequency characteristics of emission. This object is achieved by means of an electrostatic acoustic converter-loudspeaker having two parallel stationary electrodes, each electrode having a signal terminal for connection to a source of sound frequency signals. Between the stationary electrodes, there is fixed a flexible plastic partially conductive diaphragm isolated from the stationary electrodes and having a terminal for connection to a source of polarizing voltage. According to the present invention, at least one of the stationary electrodes consists of an electrically resistive layer coated over an insulating perforated plate and functioning as an ordinary resistor.

The electrically resistive layer may have an electrical surface resistance of from $10^0$ to $10^6$ ohms.

The electlrically resistive layer is divided into a plurality of sections in electrical contact therebetween, the electrical surface resistance of each section being different and the signal terminal being connected to the section having the lowest electrical surface resistance. It is advantageous that the electrical surface resistances of the sections increase progressively. The progressive increase of the electrical surface resistance of the sections may be from the center toward the ends thereof. The electrically resistive layer may also be fashioned like a spiral.

The advantages of the converter of the invention are its simplicity, the possibility of control of the polar characteristics of emission and the uniformly distributed frequency and polar characteristics of emission.

BRIEF DESCRIPTION OF THE DRAWINGS

With these and other objects in view, which will become apparent in the following detailed description, the present invention, which is shown by example only, will be clearly understood in connection with the accompanying drawing, in which:

FIG. 1 shows a cross-section of an electrostatic acoustic converter according to the invention;

FIG. 2 is a view from above of the perforated plate covered by an electrically-resistive layer having uniform or progressively increasing electrical surface from the center to the periphery;

FIG. 3 is a view from above of the perforated plate having the spiral shaped resistive conductive layer.

DETAILED DESCRIPTION OF THE DRAWINGS

The electrostatic acoustic converter of the present invention, as shown in FIG. 1 has two parallel stationary electrodes consisting of insulating perforated plates 1 and 2, the inner surfaces of which are covered by electrically resistive layers 3 and 4 respectively, acting as resistors. The electrically resistive layers 3 and 4 have respective signal terminals 5 and 6 extending through the centers of the respective perforated plates 1 and 2 for connection to a sound frequency source (not shown). Between the perforated plates 1 and 2 there is fixed a flexible plastic partially conductive diaphragm 7 which is isolated from the electrically resistive layers 3 and 4 by mean of separators 8. The diaphragm 7 has a terminal line 9 for connection to a source of polarizing voltage (not shown). The electrically resistive layers 3 and 4 are uniform, or progressively increased over their surface to the ends from $10^0$ to $10^6$ power ohms.

In FIG. 2 the insulating perforated plate 1 is round and the electrical surface resistance of the layer 3 is uniform or progressively increasing over the whole surface from $10^0$ to $10^6$ ohms.

In FIG. 3 a perforated plate 1 is round and the resistive layer 3 is spiral shaped, inductivity with distributed parameters being achieved, and the perforations being located between the coils of the spiral. The electrical surface resistance may be uniform along its whole length or progressively increasing from the center to the periphery from $10^0$ to $10^6$ ohms.

The time constant ($T=RC$) of the circuits consisting of capacitor C formed of the areas of the electrically resistive layers 3 and 4 and the respective local electrical resistance R of said layers 3 and 4, for each square unit area of the converter, define the respective local cutting frequencies. As a result, the areas with lower electric surface resistance emit over the entire sound frequency range, while at the areas having the increased electrical surface resistance, the emission of high sound frequency is limited.

Through a change of the local electrical surface resistance of the definite areas of the layers 3 and 4, the spatial and frequency characteristics of the converter may be controlled and regulated in a simple way, with improved uniformity.

We claim:

1. An electrostatic acoustic converter-loudspeaker having two parallel stationary electrodes each having a signal terminal for connection to a source of sound frequency signals and between the stationary electrodes there is fixed a flexible plastic partially conductive diaphragm isolated from the stationary electrodes and having a terminal for connection to a source of polarizing voltage, characterized in that the stationary electrodes comprise a single electrically continuous resistive layer coated over an insulating perforated plate, said resistive layer having a surface resistance without the aid of external resistors which surface resistance progressively increases from $10^0$ to $10^6$ ohms.

2. An electrostatic acoustic converter as claimed in claim 1, characterized in that the electrically resistive layer is spiral shaped.

* * * * *